US010113557B2

(12) United States Patent
Hutson

(10) Patent No.: US 10,113,557 B2
(45) Date of Patent: Oct. 30, 2018

(54) FURNACE BLOWER ASSEMBLY WITH A DIVERTER

(71) Applicant: Regal Beloit America, Inc., Beloit, WI (US)

(72) Inventor: Jeffrey C. Hutson, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 475 days.

(21) Appl. No.: 14/612,650

(22) Filed: Feb. 3, 2015

(65) Prior Publication Data

US 2016/0222979 A1 Aug. 4, 2016

(51) Int. Cl.

| | |
|---|---|
| ***F04D 29/44*** | (2006.01) |
| ***F04D 29/42*** | (2006.01) |
| ***F04D 29/60*** | (2006.01) |
| ***F23L 5/02*** | (2006.01) |

(52) U.S. Cl.
CPC ..... *F04D 29/4226* (2013.01); *F04D 29/601* (2013.01); *F23L 5/02* (2013.01)

(58) Field of Classification Search
CPC ..... F23L 5/02; F04D 29/601; F04D 29/4226
USPC ..... 415/206, 208.1
See application file for complete search history.

(56) References Cited

U.S. PATENT DOCUMENTS 1,879,342 A * 9/1932 Lauter ..... F23L 3/00 110/312
2,171,342 A * 8/1939 McMahan ..... F04D 29/422 181/207
4,722,674 A * 2/1988 Adams ..... F23L 5/02 248/604
6,206,633 B1 * 3/2001 Nakamura ..... B60H 1/00457 264/328.1
6,314,894 B1 * 11/2001 Gatley, Jr. ..... F01D 25/24 110/162
6,468,034 B1 * 10/2002 Garrison ..... F04D 29/4226 415/200
6,494,152 B2 * 12/2002 Gatley, Jr. ..... F01D 25/24 110/162
6,595,146 B2 * 7/2003 Gatley, Jr. ..... F01D 25/24 110/162
6,895,874 B2 * 5/2005 Gatley, Jr. ..... F01D 25/24 110/162
6,902,373 B1 * 6/2005 Glanton ..... F04D 29/601 415/207
6,929,448 B1 * 8/2005 Lyons ..... F04D 29/4226 415/204
7,210,903 B2 5/2007 Lyons
2011/0008152 A1 * 1/2011 Liu ..... F04D 29/4226 415/121.3

* cited by examiner

*Primary Examiner* — Umashankar Venkatesan
(74) *Attorney, Agent, or Firm* — Thompson Coburn LLP

(57) ABSTRACT

A furnace blower assembly comprising a fan housing, a fan, a motor, and a diverter. The housing defines an interior compartment, at least one air inlet, and a diverter receiving opening adapted to receive a portion of the diverter. The diverter has an air directing ramp and a discharge port. The diverter receiving opening and the diverter are adapted such that at least a portion of the air directing ramp is within the interior compartment of the housing. The air directing ramp is adapted to change direction of air flowing through the diverter receiving opening.

18 Claims, 9 Drawing Sheets

FURNACE BLOWER ASSEMBLY WITH A DIVERTER

CROSS-REFERENCE TO RELATED APPLICATIONS

Not applicable.

STATEMENT REGARDING FEDERALLY SPONSORED RESEARCH OR DEVELOPMENT

Not Applicable.

APPENDIX

Not Applicable

BACKGROUND OF THE INVENTION

The field of the invention relates generally to furnace blower assemblies.

SUMMARY OF THE INVENTION

One aspect of the present invention is a furnace blower assembly comprising a fan housing, a fan within the housing, a motor, and a diverter. The fan is adapted to rotate relative to the housing about a fan axis. The fan axis defines mutually perpendicular axial and radial directions relative to the housing. The motor is operatively coupled to the fan. The housing defines an interior compartment, at least one air inlet, and a diverter receiving opening. The diverter receiving opening is adapted to receive a portion of the diverter. The fan and housing cooperate in a manner such that rotation of the fan about the fan axis causes air to be drawn into the interior compartment via the air inlet and to exit the interior compartment via the diverter receiving opening. The diverter has an air directing ramp and a discharge port. The diverter receiving opening and the diverter are adapted such that at least a portion of the air directing ramp is within the interior compartment of the housing. The air directing ramp is adapted to change direction of air flowing through the diverter receiving opening.

In another aspect of the invention, a furnace blower assembly comprises a fan housing, a fan within the housing, a motor, and a diverter. The fan is adapted to rotate relative to the housing about a fan axis. The fan axis defines mutually perpendicular axial and radial directions relative to the housing. The motor is operatively coupled to the fan. The housing defines an interior compartment, at least one air inlet, and a diverter receiving opening. The diverter receiving opening is adapted to receive a portion of the diverter. The fan and housing cooperate in manner such that rotation of the fan about the fan axis causes air to be drawn into the interior compartment via the air inlet and to exit the interior compartment via the diverter receiving opening. The diverter has an air directing ramp and a discharge port. The diverter receiving opening and the diverter are adapted such that at least a portion of the air directing ramp is within the interior compartment of the housing. At least a portion of the air directing ramp extends obliquely from a plane perpendicular to the fan axis.

In another aspect of the invention, a furnace blower assembly comprises a fan housing, a fan within the housing, a motor, and a diverter. The fan is adapted to rotate relative to the housing about a fan axis. The fan axis defines mutually perpendicular axial and radial directions relative to the housing. The motor is operatively coupled to the fan. The housing defines an interior compartment, at least one air inlet, and a diverter receiving opening. The diverter receiving opening is adapted to receive a portion of the diverter. The fan and housing cooperate in manner such that rotation of the fan about the fan axis causes air to be drawn into the interior compartment via the air inlet and to exit the interior compartment via the diverter receiving opening. The diverter has an air directing ramp and a discharge port. The diverter receiving opening and the diverter are adapted such that at least a portion of the air directing ramp is within the interior compartment of the housing when the diverter is within the diverter receiving opening. At least a portion of the air directing ramp extends obliquely from a plane perpendicular to the fan axis when the diverter is within the diverter receiving opening.

Figure 1:
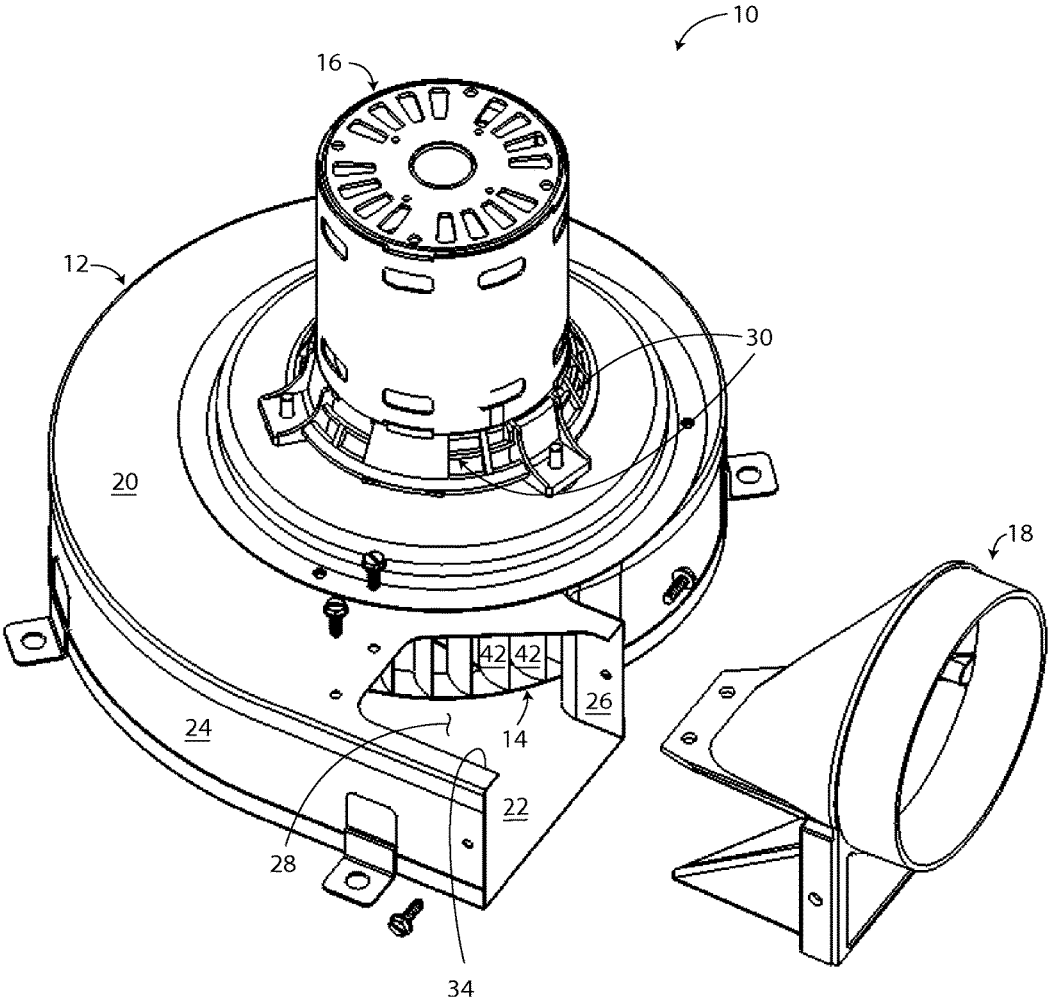
FIG. 1 is an exploded isometric view of an embodiment of a furnace blower assembly of the present invention, the furnace blower assembly having a fan housing and a diverter, the diverter being shown exploded from the fan housing.
Figure 2:
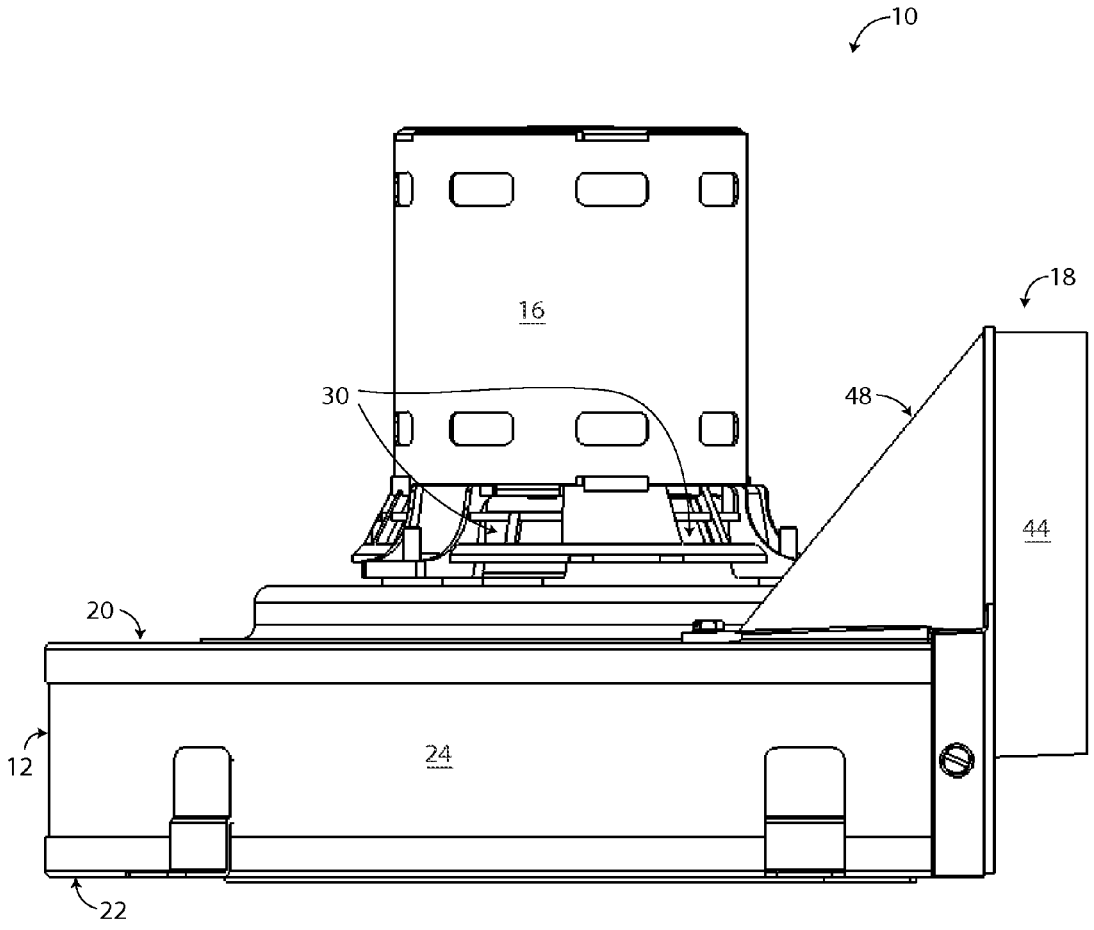
FIG. 2 is a side elevational view of the furnace blower assembly of FIG. 1, with the diverter attached to the fan housing.
Figure 3:
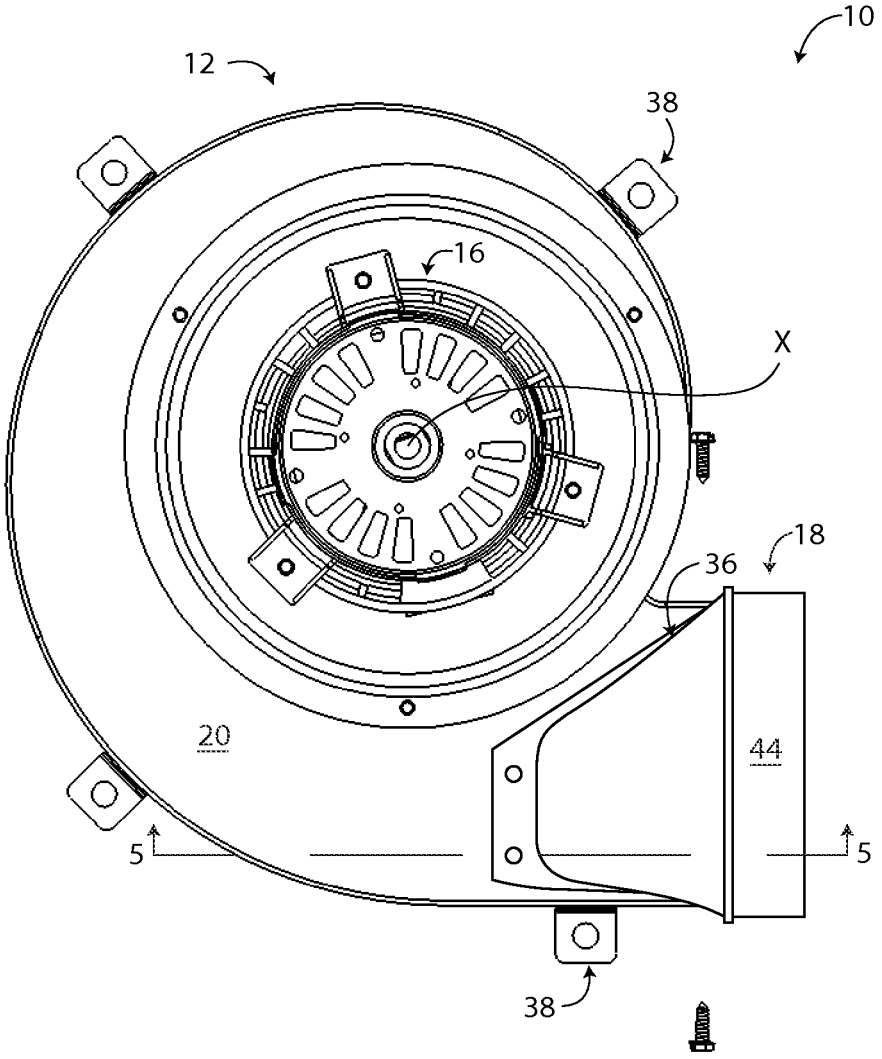
FIG. 3 is a top plan view of the furnace blower assembly shown of FIG. 1.
Figure 4:
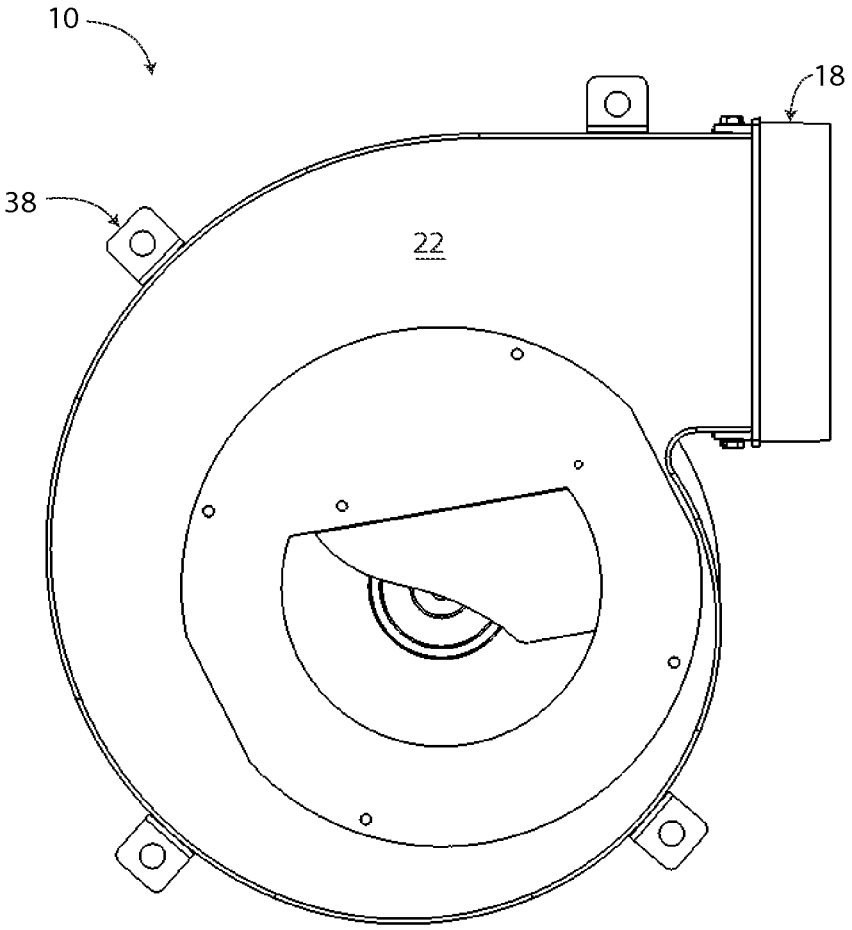
FIG. 4 is a bottom plan view of the furnace blower assembly shown in FIGS. 2 and 3.

Reference numerals in the written specification and in the drawing figures indicate corresponding items.

DETAILED DESCRIPTION OF THE PREFERRED EMBODIMENTS OF THE INVENTION

An embodiment of a furnace blower assembly of the present invention is indicated generally by reference numeral 10. The furnace blower assembly 10 comprises a fan housing 12, a fan 14, a motor 16, and a diverter 18.

Referring to FIGS. 1-5, the fan housing 12 of this embodiment includes a first end wall 20 and a second end wall 22. Each of the first and second end walls 20, 22 generally lie in a plane perpendicular to a fan axis X. The fan axis X defines mutually perpendicular axial and radial directions relative to the fan housing 12. The fan housing 12 also includes a first side wall 24 and a second side wall 26. The first and second side walls 24, 26 extend from the first end wall 20 to the second end wall 22. The fan housing 12 defines an interior compartment 28 and a diverter receiving opening 34. The diverter receiving opening 34 is adapted to receive a portion of the diverter 18. The edges of the first and second side walls 24, 26 and the first and second end walls 20, 22 collectively define an end of the diverter receiving opening 34. Preferably, a cut-out region 36 is made within the first end wall 20 to better accommodate the diverter 18. The cut-out region 36 further defines the diverter receiving opening 34. The fan housing 12 preferably comprises a plurality of attachment brackets 38 that enable the furnace blower assembly 10 to be attached to another support structure (not shown).

Figure 5:
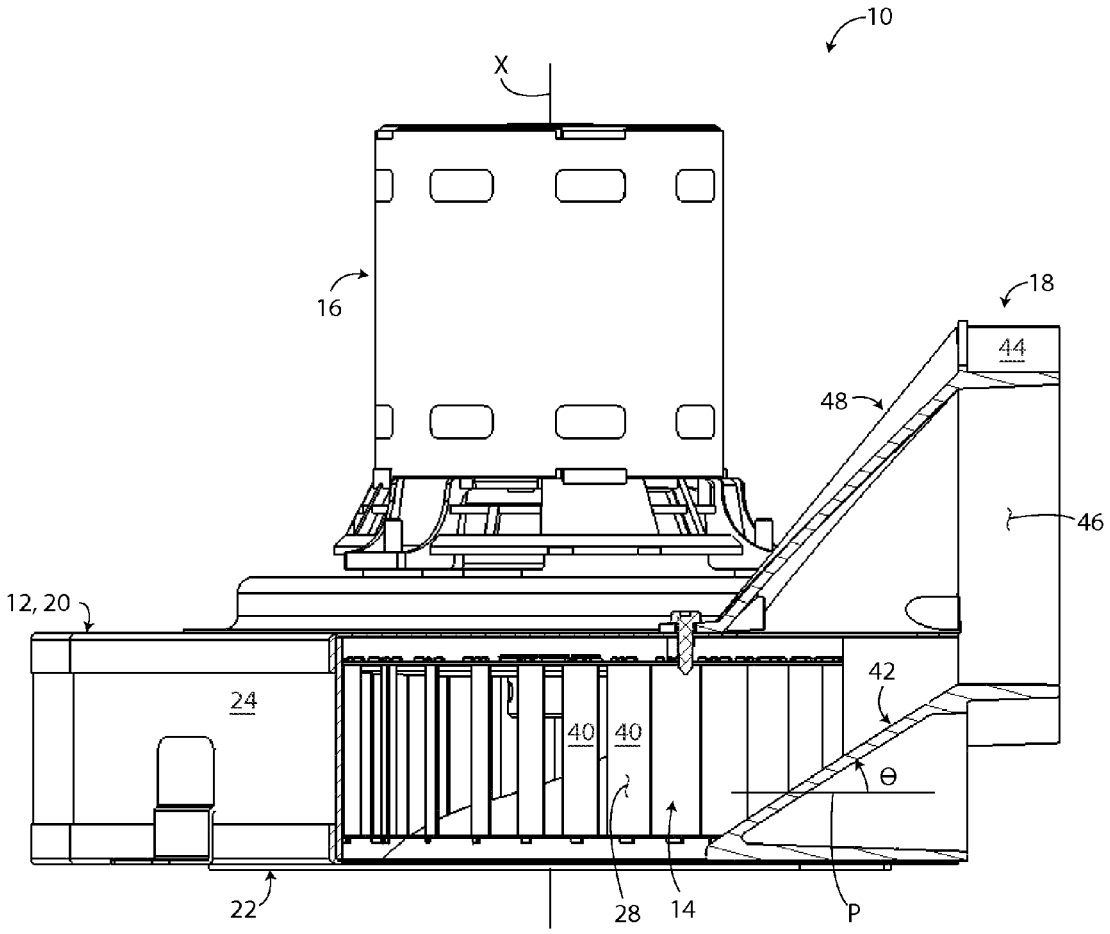
FIG. 5 is a side cross-sectional view taken along the plane of line 5-5 of FIG. 3.
Figure 6:
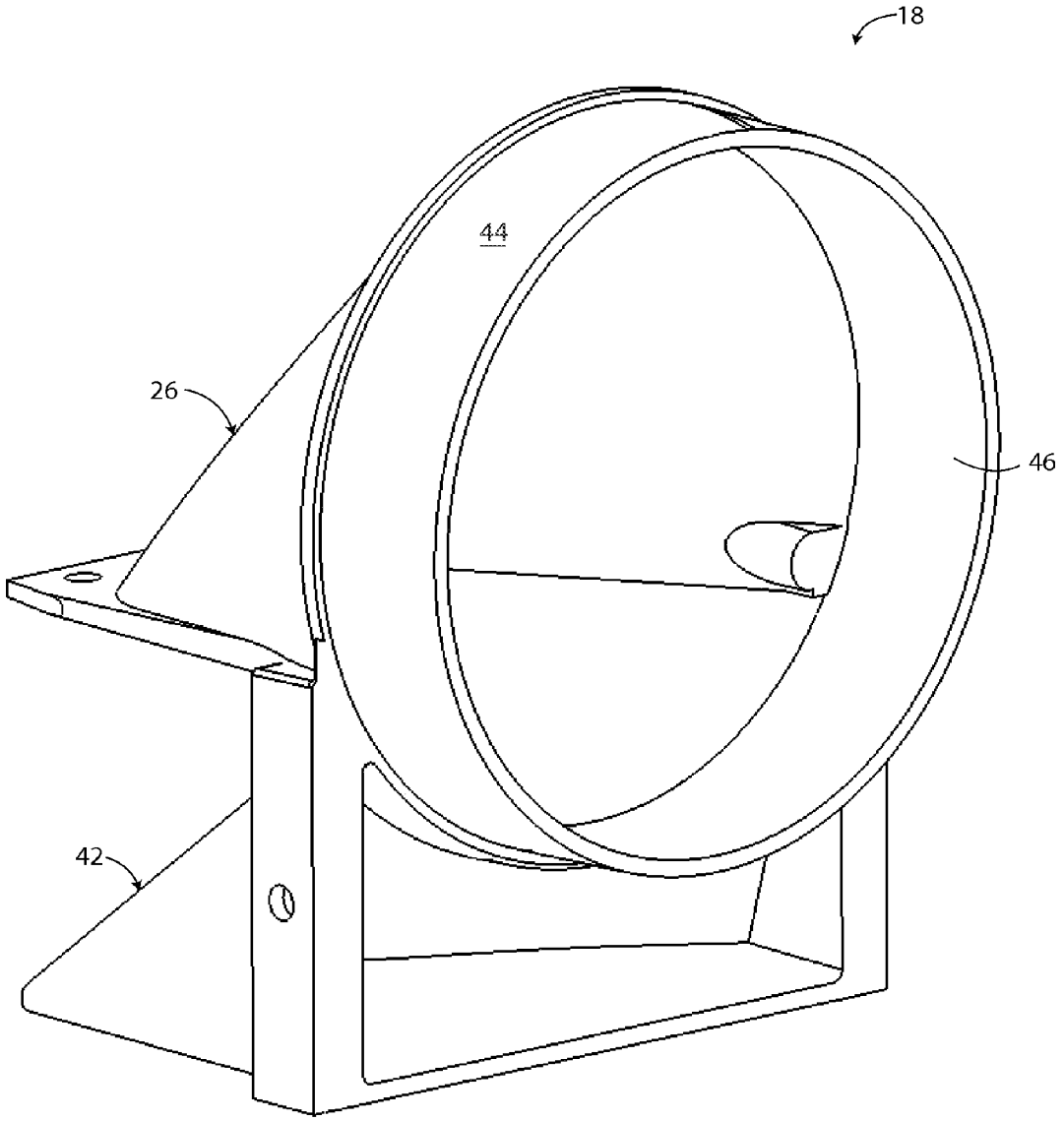
FIG. 6 is an isometric view of the diverter of the furnace blower assembly shown in FIGS. 1-5, showing a discharge port of the diverter.
Figure 7:
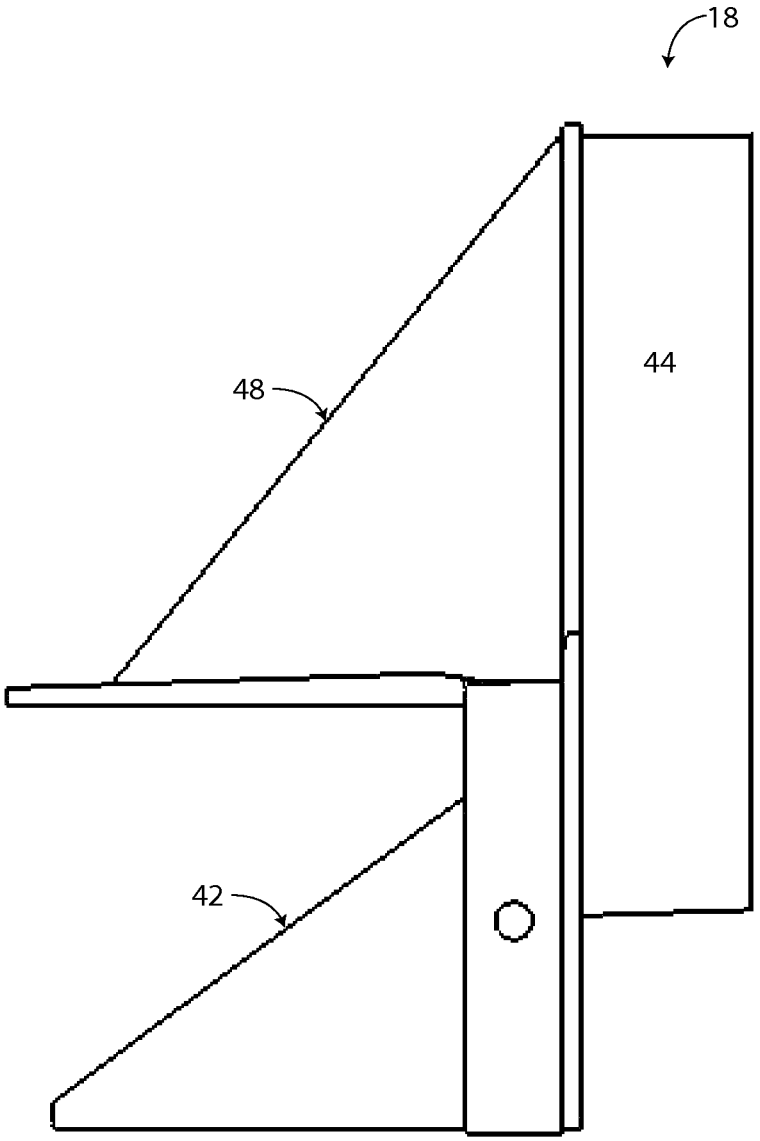
FIG. 7 is a side view of the diverter shown in FIGS. 6 and 7
Figure 8:
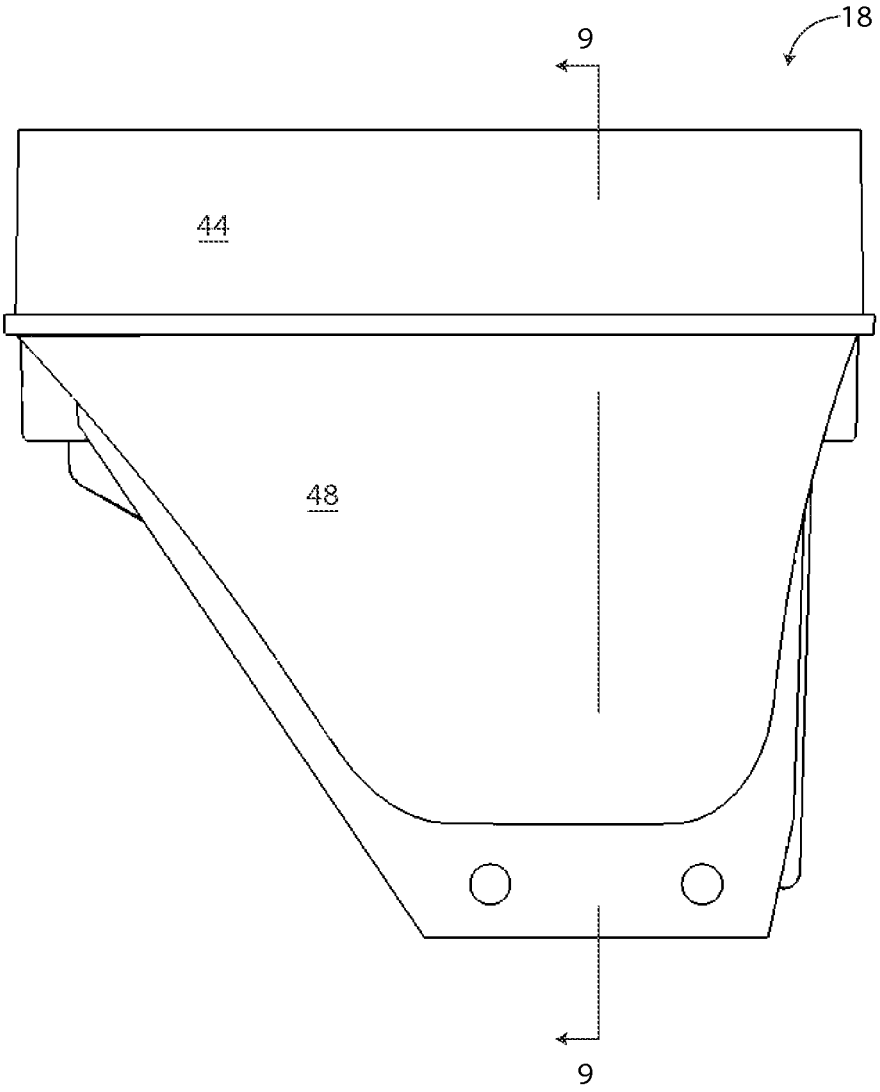
FIG. 8 is a top view of the diverter shown in FIGS. 6-8.
Figure 9:
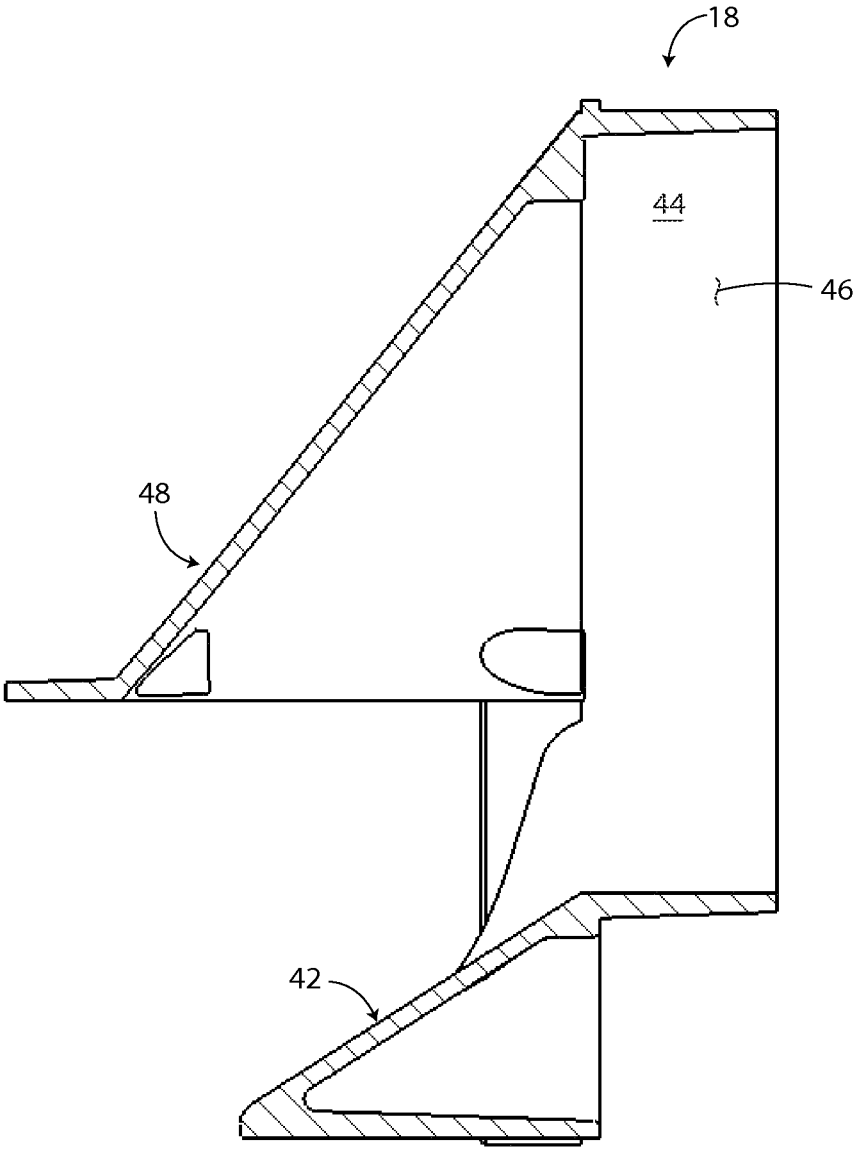
FIG. 9 is a cross-sectional view taken along the plane of line 9-9 of FIG. 8.

Referring to FIGS. 1 and 5, the motor 16 is secured to the fan housing. The motor 16 can be any suitable type of motor, including (but not limited to) an axial flux motor, a radial flux motor, or a pancake motor. The motor 16 includes a stator (not shown) and a rotor (not shown). Preferably, the motor 16 also includes a motor shaft (not shown) rotatable with the rotor. Preferably, the motor shaft extends through the fan housing 12. Alternatively, the motor 16 may be arranged in a manner such that it is located partially or entirely within the fan housing 12. The fan 14 is keyed or otherwise secured to the motor shaft such that the motor 16 is operatively connected to the fan. The fan 14 is located within the interior compartment 28 of the fan housing 12. Operation of the motor 16 causes the rotor to rotate relative to the stator to thereby cause the motor shaft and fan 14 to rotate about the fan axis X. Preferably, the fan has a plurality of axially extending impeller blades 40. The fan 14 and fan housing 12 cooperate in a manner such that rotation of the fan about the fan axis X causes air to be drawn into the interior compartment 28 via air inlets 30 and to exit the interior compartment via the diverter receiving opening 34. The axially extending impeller blades 40 are configured in a manner such that the impeller blades aid the flow of air through the fan housing 12 when the fan 14 is rotating about the fan axis X.

Referring to FIGS. 6-9, the diverter 18 preferably has an air directing ramp 42, a tubular portion 44 defining a discharge port 46, and a sloped upper wall portion 48. The air directing ramp 42 has an air directing surface that has a generally planar lower ramp portion and curved transition portions. Preferably, the air directing ramp 42 is sized in a manner such that the diverter fits tightly within the diverter receiving opening 34, thereby providing a fluid-tight seal between the diverter and fan housing 12 to prevent unwanted leaking of air. Preferably, the air directing ramp 42 is adapted to engage a portion of the second end wall 22 and the sloped upper wall portion 48 is adapted to engage a portion of the first end wall 20 of the fan housing 12 when a portion of the diverter 18 is within the diverter receiving opening 34. More preferably, the air directing ramp 42 is adapted to engage an interior surface of the second end wall 22 and the sloped upper wall portion 48 is adapted to engage a portion of an exterior surface of the first end wall 20 of the fan housing 12 when a portion of the diverter 18 is within the diverter receiving opening 34. The tubular portion 44 of the diverter 18 is adapted for attachment to a duct of a heating system (not shown). Although the tubular portion 44 is shown as having a circular cross section, it is to be understood that the tubular portion could have other suitable cross-sectional shapes (e.g., square or rectangle) for connection to ducts of other shapes.

Referring to FIGS. 1-5, the diverter 18 is adapted to be inserted into the diverter receiving opening 34. When the diverter 18 is attached to the fan housing 12, a portion of the diverter is located within the diverter receiving opening 34. Moreover, when the diverter 18 is attached to the fan housing 12, at least a portion of the air directing ramp 42 extends obliquely from a plane P perpendicular to the fan axis X. Preferably, at least a portion of the air directing ramp 42 also extends generally linearly from the plane P. Preferably, at least a portion of the air directing ramp 42 extends generally linearly from the plane P at an angle θ between 30 and 60 degrees. When the diverter 18 is attached to the fan housing 12, the air directing ramp 42 extends from the second end wall 22 of the fan housing 12 in a generally smooth transition. Preferably, the air directing ramp 42 extends generally linearly from the second end wall 22 of the fan housing 12.

When attached to the fan housing 12, the diverter 18, the first and second side walls 24, 26, and the first and second end walls 20, 22 collectively form an air passageway having a first end and a second end. The first end of the air passageway is located within the interior compartment 28 of the fan housing 12. Preferably, the first end of the passageway has a square or rectangular cross-sectional shape when viewed from a plane that is both perpendicular to the first and second end walls 20, 22 and parallel to the first and second side walls 24, 26. The second end of the air passageway is located at the discharge port 44 of the diverter 18. In this embodiment, the second end of the passageway has a circular cross-sectional shape.

Operation of the motor 16 of the furnace blower assembly 10 causes the fan 14 within the fan housing 12 to rotate about the fan axis X. The fan 14 and fan housing 12 cooperate with each other in a manner that causes air to be drawn into the interior compartment 28 of the fan housing via the air inlets 30 and exited from the interior compartment via the diverter receiving opening 34. As air exits the interior compartment 28 of the fan housing 12 via the diverter receiving opening 34, the air directing ramp 42 causes the air to flow obliquely from the plane P that is perpendicular to the fan axis X. Preferably, substantially all of the air exiting the interior compartment 28 via the diverter receiving opening 34 flows through the discharge port 44 of the diverter 18. More preferably, all of the air exiting the interior compartment 28 via the diverter receiving opening 34 flows through the discharge port 44 of the diverter 18.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A furnace blower assembly comprising:

a fan housing;

a fan within the housing, the fan being adapted to rotate relative to the housing about a fan axis, the fan axis defining mutually perpendicular axial and radial directions relative to the housing;

a motor operatively coupled to the fan;

a tubular diverter;

the housing defining an interior compartment, at least one air inlet, and a diverter receiving opening, the diverter receiving opening being adapted to receive a portion of the diverter, the fan and housing cooperating in a manner such that rotation of the fan about the fan axis causes air to be drawn into the interior compartment via the air inlet and to exit the interior compartment via the diverter receiving opening;

the diverter having an air directing ramp and a discharge port;

the diverter receiving opening and the diverter being adapted such that at least a portion of the air directing ramp is within the interior compartment of the housing, at least a portion of the air directing ramp within the interior compartment of the housing extending obliquely from a plane perpendicular to the fan axis, the air directing ramp being adapted to change direction of air flowing through the diverter receiving opening.

2. A furnace blower assembly as set forth in claim 1 wherein the air directing ramp is adapted to cause air flowing through the diverter receiving opening to flow obliquely from a plane perpendicular to the fan axis.

3. A furnace blower assembly as set forth in claim 2 wherein the housing and the diverter are adapted such that when the fan is rotating about the fan axis substantially all air exiting the interior compartment via the diverter receiving opening flows through the discharge port of the diverter.

4. A furnace blower assembly as set forth in claim 1 wherein the fan housing comprises a housing wall and wherein the air directing ramp extends from the housing wall in a generally smooth transition.

5. A furnace blower assembly as set forth in claim 1 wherein the fan housing comprises a housing wall and wherein the air directing ramp extends generally linearly from the housing wall.

6. A furnace blower assembly as set forth in claim 1 wherein said at least a portion of the air directing ramp within the interior compartment extends generally linearly from the plane.

7. A furnace blower assembly as set forth in claim 6 wherein said at least a portion of the air directing ramp extends from the plane at an angle between 30 degrees and 60 degrees.

8. A furnace blower assembly as set forth in claim 1 wherein the diverter engages an interior portion of the housing and an exterior portion of the housing.

9. A furnace blower assembly as set forth in claim 8 wherein the fan housing includes a cut-out region, the diverter receiving opening being defined in part by the cut-out region.

10. A furnace blower assembly as set forth in claim 1 wherein the portion of the air directing ramp within the interior compartment of the housing includes at least one segment that is angled relative to a plane perpendicular to the fan axis.

11. A furnace blower assembly as set forth in claim 1 wherein at least a portion of the diverter extends beyond the housing.

12. A furnace blower assembly comprising:

a fan housing;

a fan within the housing, the fan being adapted to rotate relative to the housing about a fan axis, the fan axis defining mutually perpendicular axial and radial directions relative to the housing;

a motor operatively coupled to the fan;

a tubular diverter;

the housing defining an interior compartment, at least one air inlet, and a diverter receiving opening, the diverter receiving opening being adapted to receive a portion of the diverter, the fan and housing cooperating in a manner such that rotation of the fan about the fan axis causes air to be drawn into the interior compartment via the air inlet and to exit the interior compartment via the diverter receiving opening;

the diverter having an air directing ramp and a discharge port;

the diverter receiving opening and the diverter being adapted such that at least a portion of the air directing ramp is within the interior compartment of the housing, at least a portion of the air directing ramp within the interior compartment extending obliquely from a plane perpendicular to the fan axis.

13. A furnace blower assembly as set forth in claim 12 wherein the housing and the diverter are adapted such that when the fan is rotating about the fan axis substantially all air exiting the interior compartment via the diverter receiving opening flows through the discharge port of the diverter.

14. A furnace blower assembly as set forth in claim 12 wherein the fan housing comprises a housing wall and wherein the air directing ramp extends from the housing wall in a generally smooth transition.

15. A furnace blower assembly as set forth in claim 12 wherein said at least a portion of the fan housing extends generally linearly from the plane.

16. A furnace blower assembly as set forth in claim 15 wherein said at least a portion of the air directing ramp extends from the plane at an angle between 30 degrees and 60 degrees.

17. A furnace blower assembly as set forth in claim 12 wherein the diverter engages an interior portion of the housing and an exterior portion of the housing.

18. A furnace blower assembly comprising:

a fan housing;

a fan within the housing, the fan being adapted to rotate relative to the housing about a fan axis, the fan axis defining mutually perpendicular axial and radial directions relative to the housing;

a motor operatively coupled to the fan;

a tubular diverter;

the housing defining an interior compartment, at least one air inlet, and a diverter receiving opening, the diverter receiving opening being adapted to receive a portion of the diverter, the fan and housing cooperating in a manner such that rotation of the fan about the fan axis causes air to be drawn into the interior compartment via the air inlet and to exit the interior compartment via the diverter receiving opening;

the diverter having an air directing ramp and a discharge port;

the diverter receiving opening and the diverter being adapted such that at least a portion of the air directing ramp is within the interior compartment of the housing when the diverter is within the diverter receiving opening, at least a portion of the air directing ramp within the interior compartment extending obliquely from a plane perpendicular to the fan axis when the diverter is within the diverter receiving opening.

* * * * *